US006824022B2

(12) United States Patent
Marelli

(10) Patent No.: US 6,824,022 B2
(45) Date of Patent: Nov. 30, 2004

(54) DISPENSING PUMP WITH IMPROVED SEALING FOR APPLICATION TO LIQUID CONTAINERS

(75) Inventor: Andrea Marelli, Rozzano (IT)

(73) Assignee: Microspray Delta S.p.A., Fizzonasco di Pieve Emanuele (IT)

( * ) Notice: Subject to any disclaimer, the term of this patent is extended or adjusted under 35 U.S.C. 154(b) by 14 days.

(21) Appl. No.: 10/354,970

(22) Filed: Jan. 31, 2003

(65) Prior Publication Data

US 2003/0150880 A1 Aug. 14, 2003

(30) Foreign Application Priority Data

Feb. 11, 2002 (IT) ..... MI2002A0249

(51) Int. Cl.[7] ..... B67D 5/40
(52) U.S. Cl. ..... 222/321.9; 222/321.1
(58) Field of Search ..... 222/321.1, 321.7, 222/321.9, 383.1

(56) References Cited

U.S. PATENT DOCUMENTS

| | | | | | |
|---|---|---|---|---|---|
| 4,960,230 | A | | 10/1990 | Marelli | 222/321 |
| 5,224,471 | A | | 7/1993 | Marelli et al. | 128/200.14 |
| 5,431,155 | A | | 7/1995 | Marelli | 128/200.14 |
| 5,649,649 | A | | 7/1997 | Marelli | 222/321.2 |
| 5,752,627 | A | * | 5/1998 | Vandromme et al. | 222/137 |
| 5,772,078 | A | | 6/1998 | Knickerbocker | 222/321.1 |
| 6,164,494 | A | | 12/2000 | Marelli | 222/38 |
| 6,286,726 | B1 | | 9/2001 | Marelli | 222/321.7 |
| 6,634,872 | B1 | * | 10/2003 | Bougamont et al. | 417/549 |
| 6,698,623 | B2 | * | 3/2004 | Petit | 222/153.12 |
| 2002/0175189 | A1 | * | 11/2002 | Petit | 222/321.9 |

FOREIGN PATENT DOCUMENTS

| | | |
|---|---|---|
| EP | 1 033 174 | 9/2000 |

* cited by examiner

*Primary Examiner*—Joseph A. Kaufman
(74) *Attorney, Agent, or Firm*—Oblon, Spivak, McClelland, Maier & Neustadt, P.C.

(57) ABSTRACT

A manually operable dispensing pump for application to liquid containers, in which the pump has a hollow stem which projects from a hole provided in a flange forming part of the pump, the stem having a profiled annular part which seals against a profiled seat on the flange when the pump is in its rest state, there projecting all about said flange seat a skirt within which the annular part of the stem slides and seals.

7 Claims, 3 Drawing Sheets

DISPENSING PUMP WITH IMPROVED SEALING FOR APPLICATION TO LIQUID CONTAINERS

FIELD OF THE INVENTION

Figure 1:
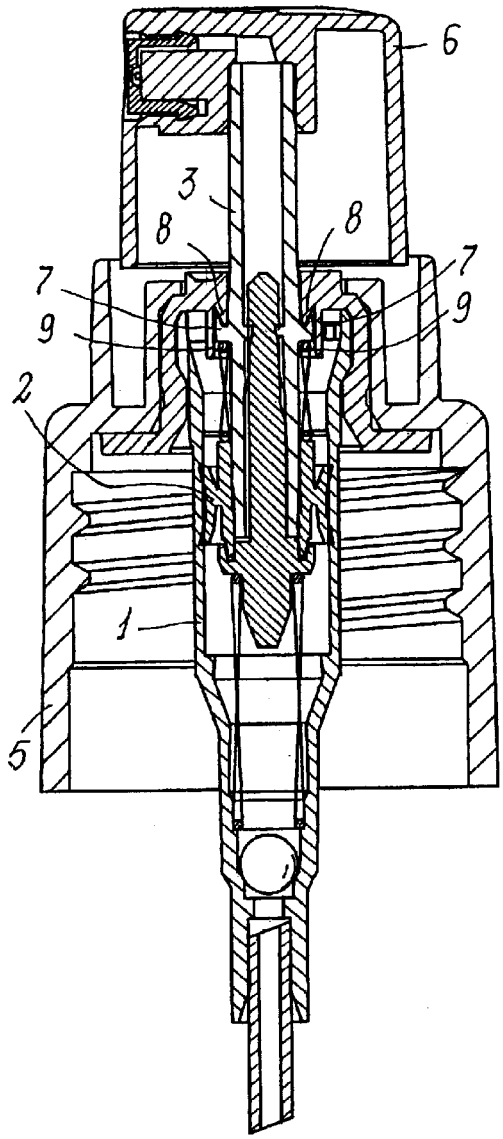

The present invention relates to a dispensing pump with improved sealing for application to liquid containers, and more particularly a pump able to prevent liquid seepage between the pump stem and the flange, even if the stem is displaced a short distance away from its rest position.

BACKGROUND OF THE INVENTION

Manually operated pumps are known for mounting on liquid containers, to dispense quantities of the liquid each time the pump is operated. These pumps have a hollow stem which projects outwards from the pump by passing through a hole provided in a flange forming part of the pump. To prevent a vacuum forming within the container when liquid is dispensed therefrom, a passageway has to be provided to enable atmospheric air to penetrate into the container, in order to maintain the pressure within it substantially constant. Normally the passage of air takes place between the outer surface of the hollow stem and the opposing surface of the hole in the flange through which the stem passes and translates with reciprocating to-and-fro movement.

During pump operation there is no liquid seepage between the stem and the flange because the container and the pump mounted on it are held in a substantially vertical position, with the pump positioned at the top. When at rest, the container and the pump mounted on it lie in a horizontal or even downwardly inclined position, especially during storage and transport. To prevent the liquid contained in the container from seeping (leaking) between the outer surface of the stem and the opposing surface of the flange forming part of the pump, it is known to provide a profiled seat on the flange (about its hole through which the stem passes) and to cause to project from the stem a profiled annular element which (when the pump is at rest) is maintained urged by the pump spring against said profiled seat on the flange, so that it seals against it.

Pumps of the aforesaid type are well known and are described, for example, in U.S. Pat. No. 5,772,078, U.S. Pat. No. 4,960,230 (and in the equivalent EP-B0301615), and U.S. Pat. No. 6,286,726 (and in the equivalent EP-B-1033174).

These pumps suffer from the drawback that, after they have been fitted (by the user) onto the container containing the liquid to be dispensed, if the container during its handling or transport is disposed horizontally or downwardly inclined, liquid can leak between the stem and flange of the pump, even if the pump stem has been displaced only a few tenths of a millimeter from its rest position as a result of an accidental stress transmitted to the stem from the outside.

SUMMARY OF THE INVENTION

The main object of the present invention is therefore to provide a pump able to prevent liquid leakage between the stem and flange of the pump, even if the stem is displaced from its closed rest position.

Another object is to provide a pump of the stated type, the structure and cost of which are substantially equal to those of a similar traditional pump.

These and further objects are attained by a pump comprising a cup-shaped body housing a translatable piston connected to a hollow stem, one end of which projects from the cup-shaped body via the hole in a flange mounted on the cup-shaped body, from the stem there projecting a profiled annular part which when the pump is at rest sealedly engages a profiled seat provided on the flange about its said hole, characterised in that from the flange there projects all about its said seat a hollow skirt the inner surface of which is cylindrical and against which there sealedly abuts the annular part projecting from the stem.

Preferably, the outer peripheral surface of the annular part of the stem presents at least one annular projection which engages the inner cylindrical surface of said skirt, the lower free surface of the annular part of the stem and/or the peripheral surface of the annular part of the stem being substantially conical, to facilitate the insertion of said annular part into the skirt.

It has been found that, for normal uses, said cylindrical skirt has a length such that the annular part of the stem remains in contact with and seals against it for a length up to 5 mm of the travel of the stem away from its rest position, however in the most common cases the length of said skirt can be such that said annular part remains in contact with and seals against it for a length less than 2.5 mm of the travel of the stem away from its rest position.

BRIEF DESCRIPTION OF THE SEVERAL VIEWS OF THE INVENTION

Figure 2:
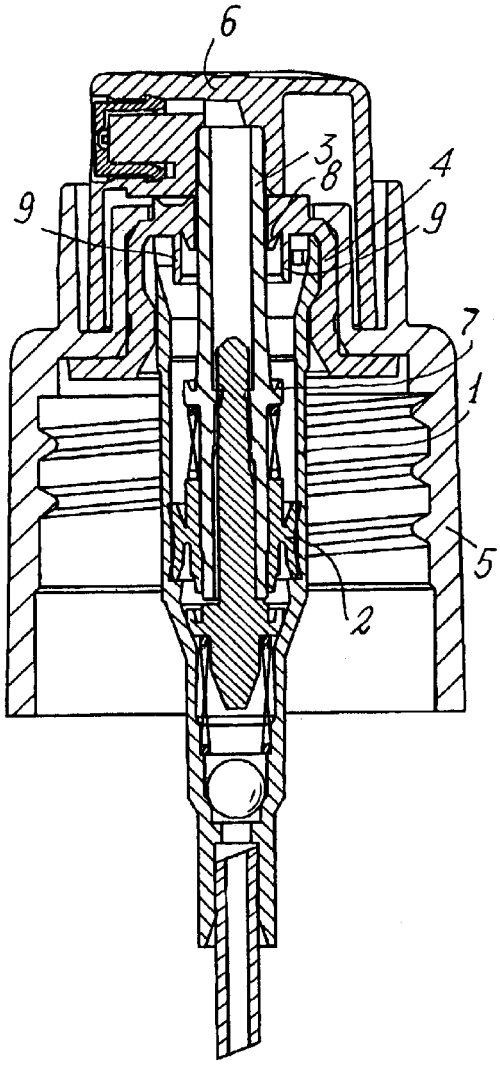
Figure 3:
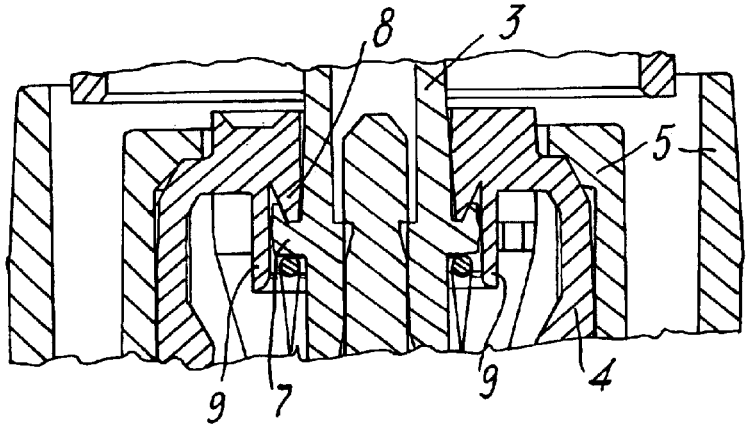
Figure 6:
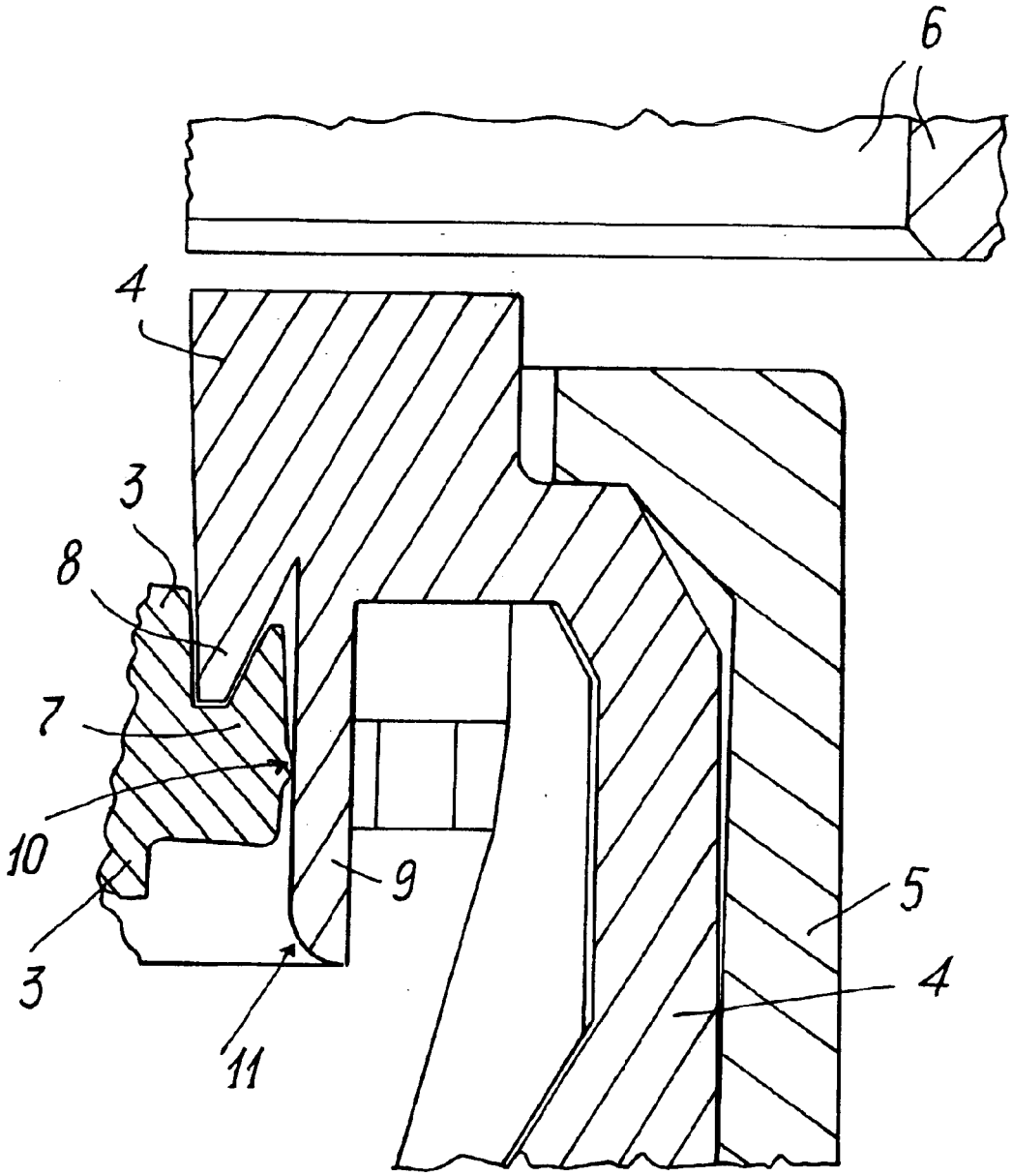

The structure and characteristics of the pump according to the invention will be more apparent from the ensuing description of one embodiment thereof, given by way of non-limiting example with reference to the accompanying drawings, in which:

FIGS. 1 and 2 are longitudinal sections through a pump shown in the rest position and at the end of a dispensing stroke respectively;

FIGS. from 3 to 5 show on an enlarged scale, in three different operating positions, a portion of a pump limited to the region in which the stem passes through the pump flange; and FIG. 6 shows, on a further enlarged scale, a portion of the pump of FIG. 3.

DETAILED DESCRIPTION OF THE INVENTION

Reference will firstly be made to FIGS. 1 and 2, which show a pump the structure of which is of known type, except for those details to be described. To give a specific example, the pump shown in FIGS. 1 and 2 is substantially equal to that described in detail in U.S. Pat. No. 4,960,230 and hence its structure and operation will not be described herein for brevity.

The pump comprises a cup-shaped body 1 translatably housing a piston 2 connected to a hollow stem 3, one end of which projects from the cup-shaped body via the hole in a flange 4 mounted on the said cup-shaped body. The pump can be fixed onto the mouth of a container for the liquid to be dispensed (for simplicity not shown in the drawing), by means of a ring cap 5 (which in the illustrated example is of the type screwable onto the container neck), a dispenser cap 6 being mounted on the free end of the hollow stem 3.

From the stem 3 there projects a profiled annular part 7 which, with the pump at rest (FIG. 1), sealedly engages on a profiled seat 8 provided on the inner surface of the flange 4 about its hole through which the stem 3 passes and can translate. All these constructional details are well known from the prior patents cited in the introduction to this description (see U.S. Pat. No. 4,960,230).

The essential characteristic of the pump of the invention is that from the inner surface of the flange 4 there projects, about the entire profiled seat 8, a hollow skirt 9 the inner surface of which is cylindrical and against which surface the annular part 7 of the stem 3 abuts and forms a seal, both when this stem is in its rest position and when it has moved away from said position.

To clarify the understanding of the function of the skirt 9 and of its cooperation with the annular part 7, reference will now be made to FIGS. from 3 to 5 which show, on a considerably enlarged scale, only that pump portion which lies in correspondence with the skirt 9. In FIG. 3 the position is that which the pump assumes in its rest state, in which it is maintained, urged by the spring forming part of the pump. It can be seen that any seepage of liquid between the stem and flange is prevented both because the annular part 7 of the stem engages the profiled seat 8 of the flange 4 (as in the case of known pumps), and because this annular part further seals against the cylindrical surface of the hollow skirt 9.

Figure 4:
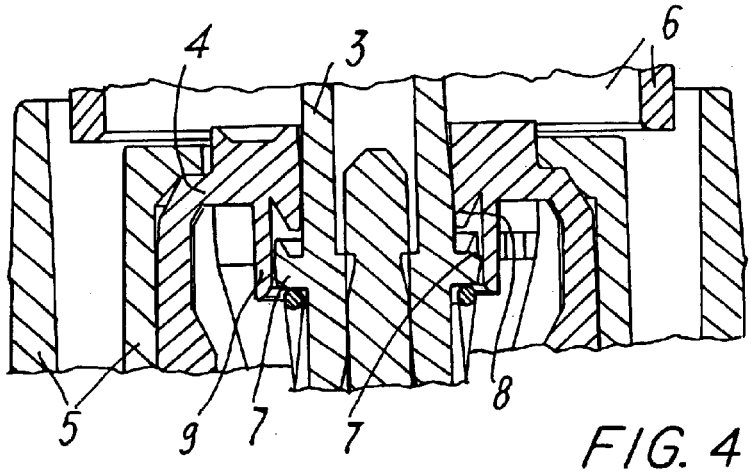

Even if the stem 3 is pressed such as to withdraw the annular part 7 from the seat 8, while said part 7 remains in contact with the inner surface of the skirt 9 (FIG. 4) the seal is assured and seepage or leakage of liquid between the stem and flange cannot occur even though the part 7 has withdrawn from the seat 8.

Figure 5:
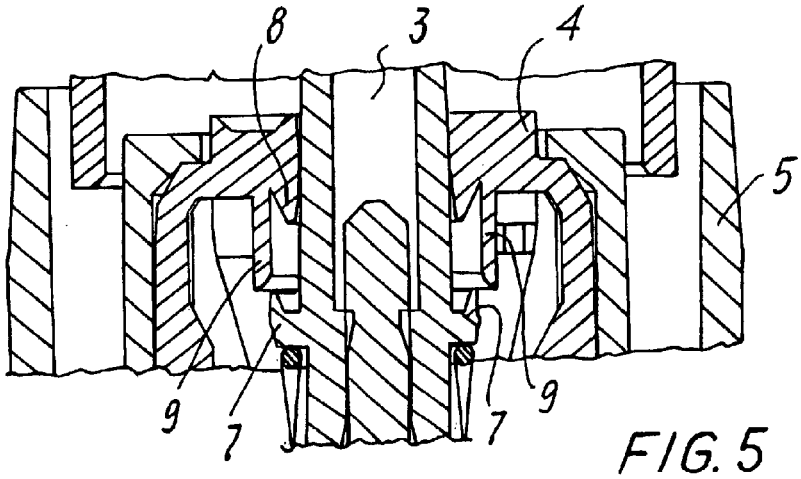

Only subsequently (FIG. 5), if the stem is further lowered so that the part 7 emerges from the skirt 9 (which can occur when the pump is operated to dispense liquid), could liquid leak between the stem and flange, but this does not in fact happen because the pump is held substantially vertical when it is pressed with the finger of one hand.

Preferably (as can be seen more clearly from FIG. 6 which shows on a further enlarged scale a detail of the pump when in the position corresponding to FIG. 3) the outer peripheral surface of the annular part 7 presents at least one annular projection 10 (only one is shown in FIG. 6) which engages the inner cylindrical surface of the skirt 9. This is advantageous especially if the stem 3 is able to oscillate laterally about its axis when in the rest state.

To facilitate correct re-entry of the annular part 7 into its cavity in the skirt 9 after leaving it (i.e. to pass from its position shown in FIG. 5 to its position shown in FIG. 4), the free end portion of the skirt presents a flare 11 (FIG. 6) and also the outer surface of the free upper edge (with respect to the figures) of the annular part 7 can be slightly conical, as can again be seen from FIG. 6.

If the skirt 9 cooperating with the annular part 7 did not exist, it could happen that during the overall handling and transport of such containers containing liquid and with the pump mounted on them, the pump stem may be caused to oscillate or withdraw from its rest position (corresponding to FIGS. 1 and 3), so withdrawing the part 7 from the seat 8. In such a case the liquid present in the container could escape between the stem and the flange if the container were in a horizontal position or inclined downwards. It is important to note that a movement of the stem of just few tenths of a millimeter from its rest position can generate liquid leakage in a pump of known type.

This does not happen if the pump has the structure shown in the drawings. Depending on the length of the skirt 9, the seal between the stem and the flange would in any event be assured while the part 7 remains in the interior of the skirt, the length of which can be less than 5 mm and even less than 2–2.5 mm, to eliminate the risk of undesirable liquid leakage by accidental stresses transmitted to the stem.

In this respect it should be noted that such accidental stresses usually cause the stem to move through a few tenths of a millimeter from its rest position during the overall handling and transport of the liquid container with the pump applied to it.

What is claimed is:

1. A dispensing pump with improved sealing for application to liquid containers, comprising a cup-shaped body housing a translatable piston connected to a hollow stem, one end of which projects from the cup-shaped body via the hole in a flange mounted on the cup-shaped body, from the stem there projecting a profiled annular part which, when the pump is at rest, sealedly engages a profiled seat provided on the flange about its said hole, wherein from the flange there projects all about its said seat a hollow skirt the inner surface of which is cylindrical and against which there sealedly abuts the annular part projecting from the stem.

2. A pump as claimed in claim 1, wherein the outer peripheral surface of the annular part of the stem presents at least one annular projection which engages the inner cylindrical surface of said skirt.

3. A pump as claimed in claim 2, wherein at least one of the lower free portions of the inner surface of said skirt and the peripheral surface of the annular part of the stem are substantially conical, to facilitate the insertion of said annular part into the skirt.

4. A pump as claimed in claim 3, wherein said cylindrical skirt has a length such that the annular part of the stem remains in contact with and seals against it for a length up to 5 mm of the travel of the stem away from its rest position.

5. A pump as claimed in claim 4, wherein the length of said skirt is such that said annular part remains in contact with and seals against it for a length less than 2.5 mm of the travel of the stem away from its rest position.

6. A dispensing pump for application to a liquid container, comprising:

a flange adapted to be mounted at an open end of a container, said flange having a hole and a profiled seat surrounding said hole;

a hollow stem movably mounted in said hole and having one end projecting from said flange and a profiled part which sealingly engages said profiled seat when the stem is at a rest position;

a valve which can open upon the movement of said hollow stem, due to pressure applied at said one end, to cause a liquid in the container to be dispensed through said hollow stem by the continued movement of the hollow stem; and a hollow skirt projecting from said flange in the direction of movement of said hollow stem, due to pressure applied at said one end, wherein said profiled part sealingly cooperates with said hollow skirt to prevent the passage of the liquid therepast.

7. A pump as claimed in claim 6, wherein the length of said skirt is less than a maximum distance by which the hollow stem can move in said direction of movement during the dispensing of the liquid in the container.

* * * * *